United States Patent [19]

Wilson

[11] 4,077,613

[45] Mar. 7, 1978

[54] PROCESS CONTAINER

[76] Inventor: William Wilson, 716 Scott St., Stroudsburg, Pa. 18360

[21] Appl. No.: 608,945

[22] Filed: Aug. 29, 1975

Related U.S. Application Data

[63] Continuation-in-part of Ser. No. 321,436, Jan. 5, 1973, abandoned.

[51] Int. Cl.[2] ..... B01F 9/00

[52] U.S. Cl. ..... 366/213

[58] Field of Search ..... 294/67 R, 67 B, 67 BB. 294/67 D, 67 DA, 67 DB, 67 DC, 68, 69 R, 73, 78 A, 86, 81 SF, 90, 91; 214/312–315, 620, 621, 650 R, 651, 652, 654; 220/1.5, 69, 70–72; 222/173, 180; 248/130–133, 137, 139, 143; 259/3, 72, 73, 75, 81 R, 89

[56] References Cited

U.S. PATENT DOCUMENTS

| | | | |
|---|---|---|---|
| 833,469 | 10/1906 | Lea | 294/68 |
| 1,429,652 | 9/1922 | Small | 259/81 R |
| 2,018,082 | 10/1935 | Muench et al. | 259/81 R |
| 2,388,987 | 11/1945 | Morrison | 214/313 X |
| 2,399,360 | 4/1946 | Lacey | 294/78 A |
| 2,622,851 | 12/1952 | Minor | 220/69 X |
| 2,971,662 | 2/1961 | Dunham | 214/313 |
| 3,086,332 | 4/1963 | Wentz | 259/89 X |
| 3,174,728 | 3/1965 | Mack | 259/89 X |
| 3,224,741 | 12/1965 | Muench | 259/81 R X |
| 3,297,350 | 1/1967 | Hidding | 294/90 X |

FOREIGN PATENT DOCUMENTS

| | | | |
|---|---|---|---|
| 515,950 | 2/1955 | Italy | 214/650 R |

*Primary Examiner*—Johnny D. Cherry
*Attorney, Agent, or Firm*—Stuart E. Beck

[57] ABSTRACT

Apparatus and a system are disclosed for storing and transporting material as well as conducting required batch processing operations on the material within a container having exterior fittings designed for use in conjunction with a quick connect-disconnect docking station. A member of the docking station is capable of interlocking with containers of different size and shapes in a positive self-positioning manner. Blending, mixing, chemical reaction, and reconstituting of liquid and/or solid material in each container or inverting of a container itself can then be accomplished without having to transfer the material to additional process equipment. In addition to the significant materials handling advantages obtained, the apparatus and system virtually eliminate pollution and contamination problems for batch processing operations.

12 Claims, 15 Drawing Figures

Fig. 7
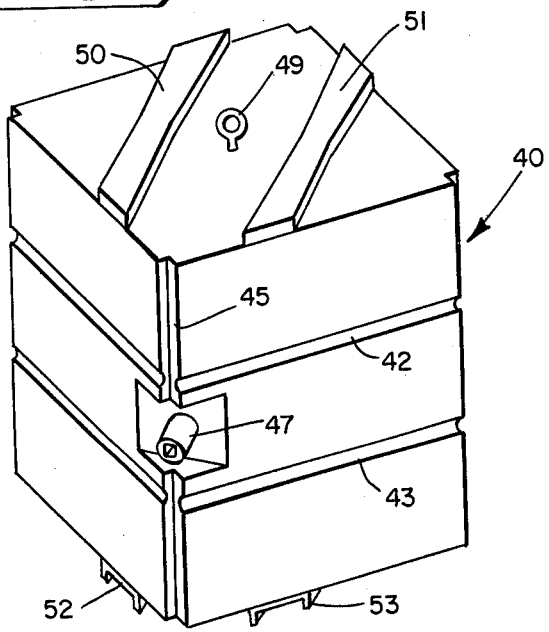
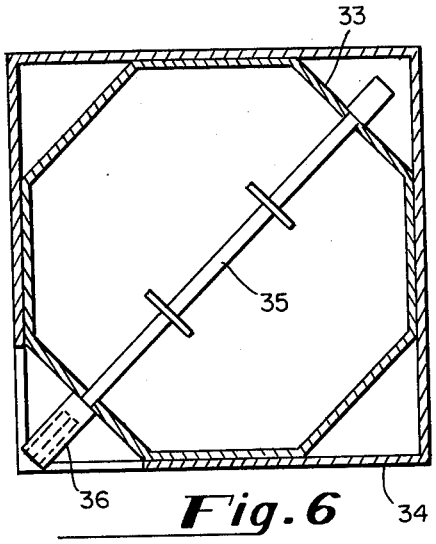
Fig. 6
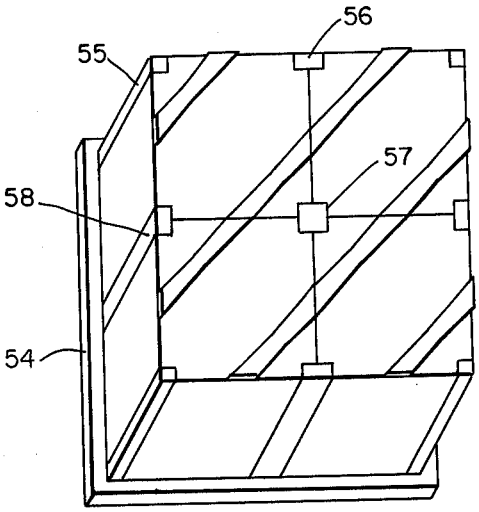
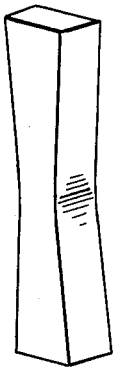
Fig. 9
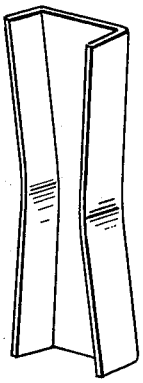
Fig. 8
Fig. 10
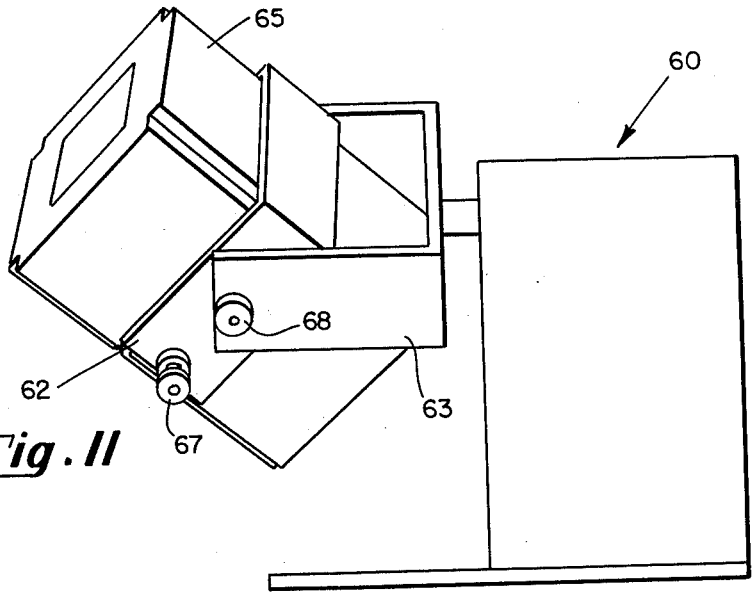
Fig. 11

PROCESS CONTAINER

CROSS-REFERENCE TO RELATED APPLICATION

This application is a continuation-in-part of Ser. No. 321,436, filed Jan. 5, 1973, now abandoned.

FIELD OF THE INVENTION

The present invention relates to process container apparatus and a system and, more particularly, to apparatus and a system for obtaining improved materials handling by storing and transporting material as well as conducting required batch processing operations on the material within the same container.

BACKGROUND OF THE INVENTION

Conventionally, industrial mixing devices have been permanently located. Utilization of such equipment has accordingly required that material to be mixed or blended to transported to the mixing devices, removed from one or more storage containers, inserted into the mixing devices, mixed or blended, removed from the mixing devices and placed inside new storage or shipping containers. Of course, the mixing devices must be cleaned periodically and normally after every batch operation. These various operations obviously require considerable time and labor in addition to creating storage problems for containers. Completely automated systems for batch type operations can be devised but tend to be somewhat rare. Not only are automated systems costly, but such automation tends to defeat flexibility — an inherent advantage of batch operations.

In addition to the time and expense involved with materials handling aspects of batch type operations, the problem of contamination and pollution control are very significant. In industries such as the pharmaceutical industry and food industry product purity is synonymous with product quality. The very real and serious hazards which can occur by cross contamination of pharmaceutical ingredients have led the Food and Drug Administration of the U.S. Government to require very rigid housekeeping efforts to eliminate contamination problems. This has meant that equipment such as mixing equipment which is used to perform its function with a variety of product formulations must be cleaned laboriously between runs of different material. The problem, however, involves more than simply the time consuming effort required to clean previously used containers and mixing equipment. Part of the existing problem is the exposure of material to the plant environment, including solid materials and vapors, and the effort required to prevent migration of material either into the plant environment or of impurities into the material from the plant environment. Environment control is exceedingly difficult when material is being transferred back and forth between containers and processing equipment. The solutions which have been suggested for combating problems of contamination and environmental pollution, including such practices as segregation of different product operations, utilization of vacuum systems to combat dust problems, and the like, all have recognized limitations.

Included among the various devices and procedures which have been proposed for handling both solid and liquid materials in an attempt to obtain improved handling procedures are those proposed by Schmidt and Wheeler. U.S. Pat. No. 3,315,945, to Alfred Schmidt, as well as U.S. Pat. No. 4,090,604, to Delbert Wheeler, involve equipment designed to be used in conjunction with a standard 55 gallon metal drum for mixing the contents of the drum. According to the Schmidt patent, the metal drum must be clamped to a circular frame which is then rotated in order to accomplish some form of mixing. The Wheeler patent also involves means for securing a metal drum to a frame which is then moved to accomplish some form of mixing action. The objective in both the Schmidt and Wheeler patents is to position a standard industrial drum at an angle which will promote efficient mixing of the container contents. Movement of a 55 gallon industrial drum containing granular powder or liquid material, however, can be very difficult even with leverage applied to the drum. There is simply no convenient or quick way of mounting a 55 gallon industrial drum in the apparatus taught by Schmidt and Wheeler or convenient or quick way of introducing variations in drum size.

Suppliers of specialized storage containers have also offered some improvement in the materials handling aspects of batch processing apparatus. Today portable bins of various kinds are frequently employed for charging and discharging process machines, transferring materials between processing machines and storing materials, including the raw materials, intermediates and final product. In reality, such bins are simply glorified versions of the standard 55 gallon metal drum which has conventionally been used in industry for storing and shipping liquids and dry bulk material. For convenience, the portable bins are normally equipped with resealable openings, piping to facilitate removal of contents, and corner extensions which permit stacking the bins during shipment or storage. Notwithstanding the use of specially designed storage containers, charging and discharging the containers remains time consuming, costly, dirty and troublesome and it has been almost impossible in batch type operations to approximate the coordination of storage, movement and processing that is taken for granted in continuous operations.

Another approach which has been proposed in order to reduce capital equipment costs and improve overall efficiency has been to employ multiple cone blenders in conjunction with one drive unit. Use of cone type hoppers which can be bolted one at a time to a single drive unit has helped to reduce capital investment costs in some operations, but has not overcome contamination, storage, transfer, interplant shipment and cleaning problems. Of course, the drive unit can only be used with a fixed hopper size.

Process container apparatus and a system have now been developed which provide clean, safe, economical and flexible materials handling for bath type operations. By improving the materials handling aspects of batch operations the efficiency of an entire manufacturing operation can be improved.

SUMMARY OF THE INVENTION

An object of the invention is to provide apparatus and a system for improving liquid and/or solid materials handling procedures, particularly in batch type operations.

Another object of the present invention is to provide apparatus and a system which can be economically and conveniently employed for multiple functions.

Still another object of the present invention is to provide apparatus and a system which can be used for storing, transporting and mixing materials in a clean, safe and flexible manner.

Yet another object of the present invention is to provide apparatus and a system which will reduce exposure of material and thereby virtually eliminate contamination, pollution, safety and corrosion problems in batch type materials handling operations.

In accordance with the present invention apparatus and a system are provided for storing and transporting materials and conducting required batch type processing operations on the materials within the same container. The system utilizes a container having fittings designed for use in conjunction with a quick connect-disconnect docking station. The docking station not only causes the container to be positioned at a precise location, but can be used to accomplish mixing or blending of material inside the container without requiring material to be removed from the container. In a preferred embodiment the fittings on the container are recessed grooves adapted to become engaged with corresponding projections located on an L-shaped arm, V-shaped arm or combination of two L-shaped arms of the docking station. Fittings on or connected to the container provide an angle, irrespective of the interior shape of the container, which matches interconnecting fittings of the docking station. In another preferred embodiment the container is equipped with a mixing bar capable of rotation which becomes engaged once the container is connected to the docking station. A further embodiment provides flared shaped channels on the container for use in lifting, transporting and positioning the container as well as for stacking and interlocking multiple containers.

BRIEF DESCRIPTION OF THE DRAWINGS

Other and further objects, advantages and features of the invention will be apparent to those skilled in the art from the following detailed description thereof, taken in conjunction with the accompanying drawings, in which:

FIG. 6 is a top view in cross section of an octagonally shaped container equipped with a square frame adapted for use in the present invention and further illustrates a removable rotating bar present in the container which can be engaged when the container is placed in a docking station;

FIG. 7 is a perspective view of a container for use in the present invention which illustrates certain structural aspects which can be incorporated into the container, including a lifting hook, interlocking channels and the outside connection for an internal mixing bar, such as that illustrated in FIG. 6;

FIGS. 8 and 9 are diagrammatic drawings which illustrate the preferred flared shape of the channel members used for stacking and interlocking containers in accordance with the present invention, the channel member illustrated in FIG. 9 being expressly designed to be attached to the top of the container and the receiving channel member illustrated by FIG. 8 being designed to be attached to the bottom of the container;

FIG. 10 is a perspective drawing which illustrates the interlocking of multiple containers on a pallet;

FIG. 11 is a side view of a docking station interlocked with a container, in which the docking station has two "L" shaped interconnected arms attached to another pair of two "L" shaped interconnected arms for positioning a container of a specific size to the optimum angle for mixing;

DESCRIPTION OF THE PREFERRED EMBODIMENTS

In accordance with the present invention one container can be used for storage and transportation of material as well as the processing of the material thereby providing clean, safe, economical and flexible materials handling. Utilization of one container for these different functions means that product contamination is virtually eliminated, pollution problems are minimized, there is a reduction in cost, time and handling problems, there is a reduction of required cleaning operations and a resulting improvement in safety. Safety in handling materials is of course of particular concern in dealing with explosives, corrosive materials, poisonous materials and also materials which involve physiological hazards. While product contamination is perhaps of primary concern in connection with the pharmaceutical and food processing industry, the reduction in overall plant housekeeping activities as well as reduction in cost of plant equipment is of significance to every industry.

Figure 1:
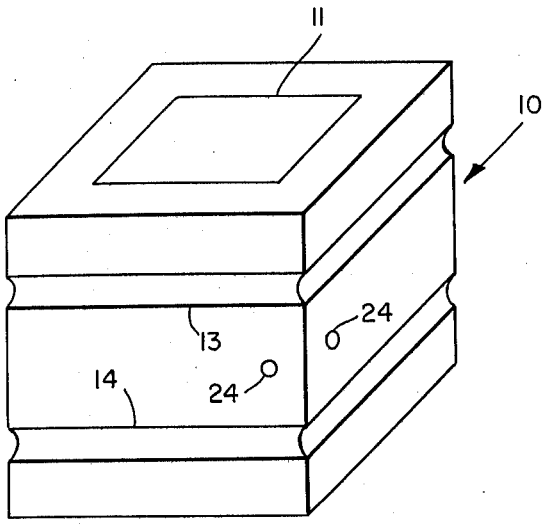
FIG. 1 is a perspective view of a container designed for use in connection with the present invention, having recessed fittings located along at least two sides of the container.
Figure 3:
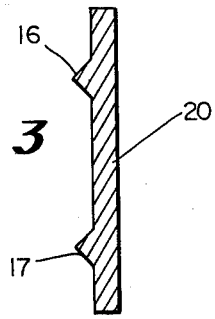
FIG. 3 is a side view in cross section along line 3—3 of FIG. 2, illustrating the rails on an arm of the docking station which connects with recessed fittings of containers used in the process of the invention.

Referring to FIG. 1, the containers which can be utilized in accordance with the present invention can be of almost any shape provided that at least two sides of the container are equipped with an L-shaped or V-shaped frame having fittings adapted for connection with a docking station, as hereinafter described. Container 10 illustrated in FIG. 1 is a square container which is equipped with any desired number, shape and size of openings, such as opening 11, which will facilitate the transfer of materials to and from the container. Parallel grooves 13 and 14 are illustrated as recessed transversely extending fittings on at least two of the sides of container 10, and these grooves, which may be present on all of the sides, are designed to interconnect with rails projecting from an L-shaped arm of the docking station illustrated in FIG. 2. As seen in FIG. 3, rails 16 and 17 projecting from arm 20 of the L-shaped docking station are spaced exactly the same distance apart as parallel grooves 13 and 14 of container 10. Accordingly, when container 10 is connected with docking station 18, two side walls of container 10 contact arms 20 and 21 of docking station 18.

Fittings such as grooves 13 and 14 are recessed in order to avoid any protrusions on the outside of container 10 which would interfere with the transportation, storage or other utilization of the container. In special cases, however, members could be attached onto the side of a container to provide fittings required for connection with corresponding recessed fittings on the docking station. Obviously, the shape and number of the rail members which become engaged in the grooves is important. Preferably, at least two rails are present. For special applications a single rail might be used. It will also be understood that in certain instances more than two rails, i.e., three or four rails, could be employed. The rails are preferably triangular in shape. Other rail shapes can obviously be used, including rails trapezoid in shape, half rounded in shape and even rectangular in shape. Provided a uniform distance between container fittings is maintained any number of containers can be used in conjunction with the same docking station. It will be seen that container 10 becomes firmly interconnected with docking station 18.

Figure 2:
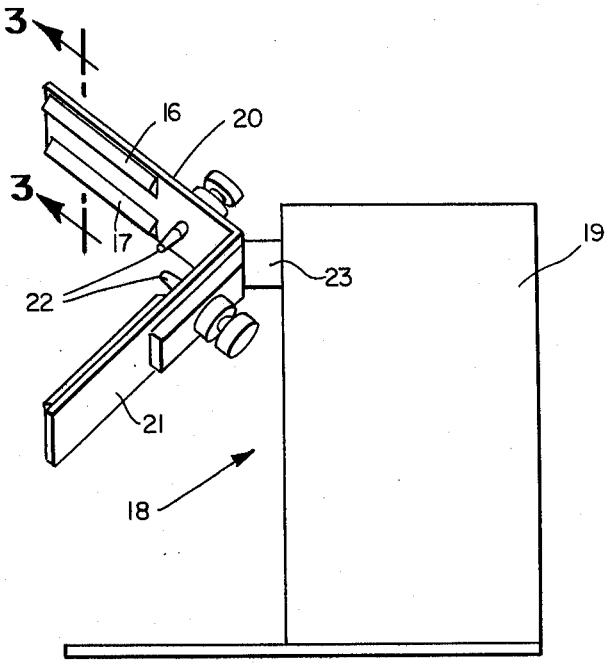
FIG. 2 is a side view of a docking station in accordance with the present invention which is designed with L-shaped arms for quick and positive connection with a container, such as the container illustrated in FIG. 1.

Once the container is in position it can be securely locked in place by pressure exerting means such as mechanically, electrically or hydraulically actuated wedges, or other means. Pins 22—22 are shown in FIG. 2. These pins normally would be retracted until a container has been positioned in the docking station and then said pins are actuated by suitable means to be received in and engaged by complimentary apertures 24 in the container and lock it securely to the arms of the docking station. Locking can be obtained by using wedges or blocks applied against outer walls of the container, said wedges or blocks being actuated either simultaneously or separately and in addition to or independent of the pins. This locking assures positive engagement of the rails with the corresponding fittings of the container and such locking normally is required if the container is to be rotated by the docking station. Other means which are not as preferred include the use of a band, strap, or retaining arm clamped to or around the container after it has been connected to the docking station.

Referring to FIG. 2, docking station 18, which can be maintained in fixed or movable position, consists of member 19 which is normally attached to the floor but which can be mounted on a wall or even supported from the ceiling. Arm members 20 and 21 of docking station 18 are normally of equal length and positioned at a suitable angle to each other such as the right angle illustrated. These side members or arms are equipped with one or more projecting rails, such as rails 16 and 17, for connection with containers of the invention. Arm members 20 and 21 are elevated from the floor or base of the docking station sufficiently to permit a container such as container 10 (FIG. 1) to be completely rotated around bearing 23 when container 10 is interlocked to docking station 18. Docking station 18 can be adapted for either rotating a container to simply invert it, or to rotate a container to blend, mix or reconstitute materials inside, depending on the type of mixing, blending or mechanical action required. Thus, rails 16 and 17 effect positive positioning for quick connect-disconnect and rapid locking. In addition, the rails cause the driving torque to be distributed over a large area when the container is rotated. The present invention permits the docking station to be centrally located which results in a reduction of capital investment costs with respect to architecture and satellite equipment.

Figure 4:
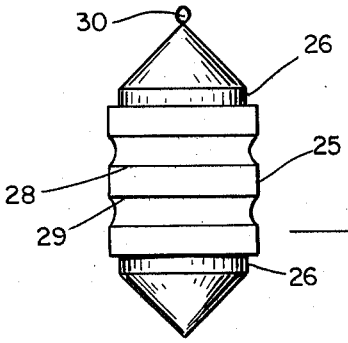
FIG. 4 is a side view of a rectangular frame holding a cylindrical cone-shaped container and illustrates another shape of container which can be utilized in accordance with the present invention.

Referring to FIG. 4 frame 25 is placed around cylindrical shaped container 26 having cone shaped ends. Since frame 25 is equipped with grooved fittings 28 and 29, it can be inserted into the docking station illustrated in FIG. 2. The frame or skirt 25 need not extend the full length of the container. Instead of having the frame around the container the frame can consist of two side walls joined together at one end in an appropriate angle, e.g., a right angle, and open at the other end to accept a container, such as a drum, which can be connected to the frame between the two side walls that are joined together. Utilization of the cone shaped container 26 inside frame 25 permits all the advantages of fast, gentle, uniform blending inherent with mixing operations using that shape of container. A forklift device or other means, such as a device which will lift container 26 by lifting hook 30, can be utilized to bring container 26 inside frame 25 to a docking station.

Figure 5:
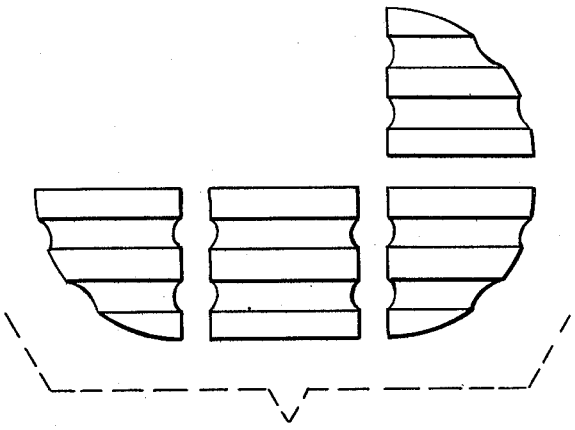
FIG. 5 is a side view of four containers which are shaped to fit inside an airplane fuselage and this figure illustrates still further container shapes which can be utilized in the present invention.

Another container shape which can be utilized in connection with the present invention is illustrated in FIG. 5. In this embodiment four sections of a six section container are illustrated which can be fitted together. These sections are adapted to fit inside an airplane fuselage. The illustrated container sections are equipped with grooved fittings which permit them to be connected with a docking station, such as docking station 18 in FIG. 2.

FIG. 6 illustrates yet another container shape, specifically an octagonal shaped container 33, inside square frame 34 which is equipped with fittings (not shown) necessary for connection with a docking station. It will thus be seen that as long as either the container itself or a frame surrounding the container is equipped with necessary fittings for quick connect-disconnect operations with a docking station, a variety of different shapes and types of containers as well as materials for construction of containers can be utilized. In fact, as long as the outside frame 34 is constructed of a rigid material, the internal container itself 33 (FIG. 6) which is attached to the frame need not be constructed of metal. If desired, internal container 33 can be made of plastic, rubber, fabric or a similar material. Provided the fittings on a container match the fittings on the arms or side walls of the docking station, the container frame can be either shorter, the same size or longer than the arms or side walls. This fact means that containers of varying sizes, configuration and material construction can be used with the same docking station.

In addition to the mixing and blending operations which are possible by rotation and/or other action using a docking station, containers of the present invention can be equipped with a mixing bar, such as a removable mixing bar 35 illustrated in FIG. 6. By equipping a docking station with means for engaging end 36 of mixing bar 35, the mixing bar can be rotated when container 33 and frame 34 are connected with the docking station. With such a mixing bar internal mixing can occur either independent of or simultaneous with the mixing or blending caused by any rotation or vibration of the container by the docking station.

Referring to FIG. 7, container 40 is illustrated which in addition to recessed grooves 42 and 43, the fittings required for connection with a docking station, has vertical channels, such as channel 45, located along each corner edge of the container. As previously explained, grooves 42 and 43 provide fittings necessary for connecting container 40 with a docking station. The structure provided by grooves 42 and 43 as well as channel 45, also improve the structural rigidity of the container compared to a perfectly flat side wall rectangular storage bin. When the entire top of a container is removable the top can be locked into position by retaining means located in channel 45 so as not to protrude from the container. Removal of the entire top and/or bottom is especially advantageous when a void cap is attached to the container for mixing. A further feature of vertical channel 45 in connection with the elimination of container shifting when stacked by using vertical tie bars, will be referred to below in connection with FIG. 10.

FIG. 7 also illustrates a recessed opening 47 which permits connection to be made between an internal mixing bar (not shown) and a docking station (not shown). While lifting eye 49 appears in the drawing, container 40 is preferably transported by means of a conventional fork lift truck. Lifting eye 49, which can be on any or all sides of the container, is protected by channels 50 and 51 which are described below.

Flared channels 50, 51, 52 and 53 are preferably attached to container 40 as shown in FIG. 7. These channels facilitate the stacking and interlocking of containers. Channels 50 and 51 have a closed flared configuration as illustrated in FIG. 9. Channels 52 and 53, on the other hand, have an open flared configuration as illustrated in FIG. 8, adapted to fit over the corresponding closed channels. The difference in size between the channels of FIGS. 8 and 9 is just sufficient to permit them to become easily intermeshed. Because of the configurations of these interlocking channels, containers can be safely stacked one on the other. The chanels can be positioned at any suitable angle, e.g., a 45° angle, and spaced apart at a distance equal to the width of the tongs on a conventional fork lift truck making it possible for the container to be picked up by inserting the tongs of the fork lift truck into the ends of the channels. Preferably, the channels are slightly wider even at the narrowest point in their flared configuration than the width of the tongs of a fork lift truck. This not only facilitates picking up container 40 using a fork lift truck but facilitates the docking operation because the lateral variance provides for non-critical docking. As grooves 42 and 43 of container 40 (FIG. 7) become engaged with the rails of a docking station, some shifting occurs because of the automatic alignment caused by the side wall configuration of the docking station. If the channels are wider even at their narrowest point than the tongs of the lift fork truck, container 40 automatically turns and becomes aligned in the docking station without binding.

In FIG. 10 several containers are stacked together on pallet 54. Vertical members, such as vertical members 55, 56, 57 and 58, which can be attached to the pallet, serve to guide and also retain the containers in their position on the pallet during movement of the pallet itself. While FIG. 10 illustrates only four containers positioned on a pallet, it will be understood that any number of containers can be arranged to fit on a pallet and that the containers can, if desired, be stacked one on the other in layers.

In FIG. 11 two L-shaped arms are joined together and attached to a docking station 60. Arm 62 and its corresponding arm are actually movable in frame 63 to permit a container 65 to be tilted at an angle, e.g. 45°,which is known to provide classic blending action. Suitable locking means such as pins 67 and 68 can be used to retain container 65 at the desired angle while the container is being rotated by docking station 60. Although the double L-shaped arms of docking station 60 establish the width of the container which can be used in the docking station, the arms do not limit the depth or height of the container.

Figure 13:
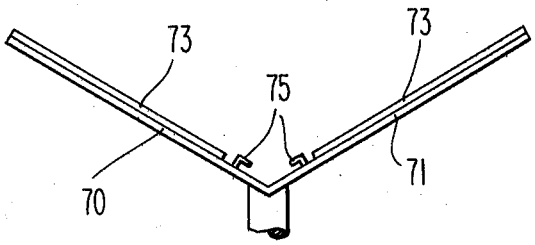
FIG. 13 is a top view of the V-shaped arms of the docking station illustrated in FIG. 12.
Figure 12:
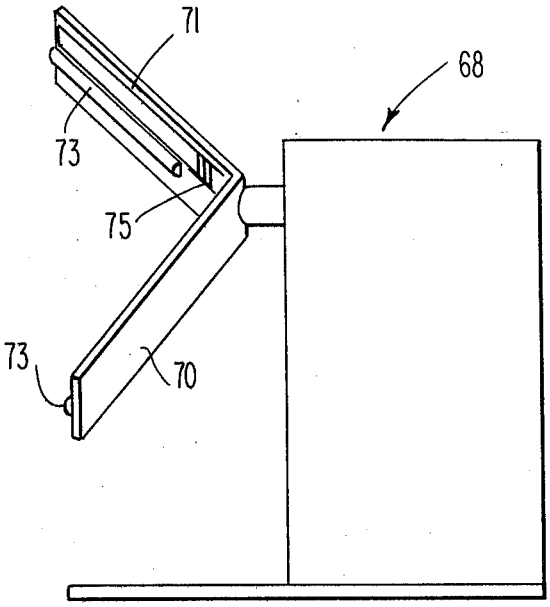
FIG. 12 is a side view of a docking station in accordance with the present invention which is designed with V-shaped arms for quick and positive connection with a suitable frame connected to a rigid or flexible container.

FIG. 12 illustrates a docking station 68 in which the V-shaped retaining arms 70 and 71 are at an angle greater than 90°. This can best be seen in FIG. 13. Only one rail projects from arms 70 and 71 for interconnection with corresponding fitting means on a container or frame member. The rails which are illustrated, rails 73—73, are semirounded in shape. Sliding interlock means 75—75 are illustrated for firmly securing a container to arms 70 and 71 of the docking station. A track for sliding interlock 75 is shown in FIG. 12 along arm 71. That intrlock can engage the outer edge of a container, abut up against a vertical channel, such as vertical channel 45 in FIG. 7 or engage a clamping member, such as member 79 described hereinafter with respect to FIG. 14.

Figure 14:
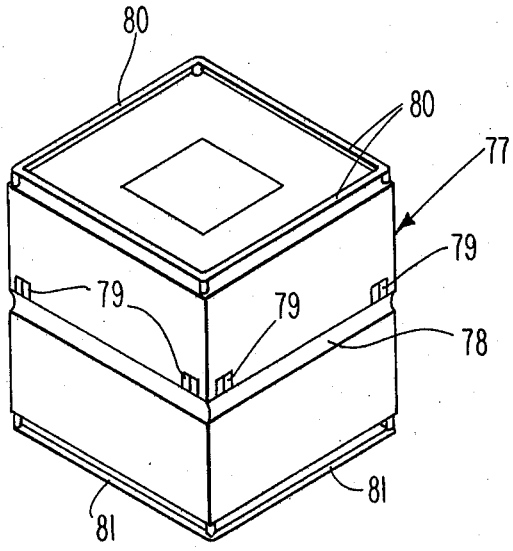
FIG. 14 is a perspective view of a container designed for use in connection with the present invention, having only one interconnecting channel member located along at least two sides of the container.

FIG. 14 illustrates a container 77 having only one groove 78 on at least two sides. At each end of groove 78 clamping means 79—79 are shown which can be used to secure container 77 firmly to a docking station. A rigid pipe frame structure 80 and 81 extends around the top and bottom of container77, respectively. This frame structure permits the tongs of a fork lift truck, for example, to be inserted between the frame and the container for lifting the container.

Figure 15:
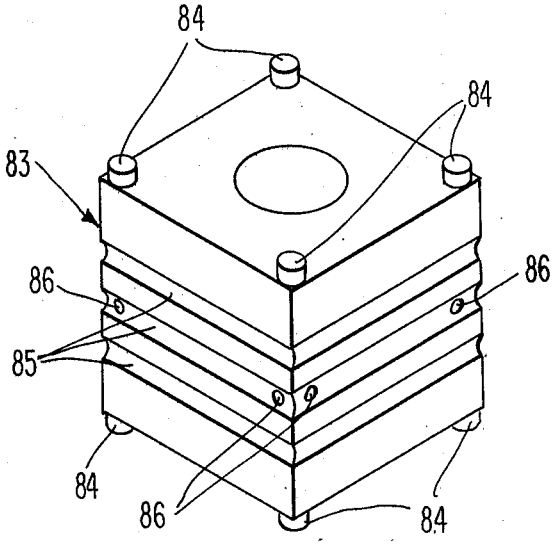
FIG. 15 is a perspective view of a container designed for use in connection with the present invention, having three parallel recessed fittings located along at least two sides of the container.

FIG. 15 illustrates still another container 83 having corner "feet" 84—84 on both its top and bottom. Three grooves 85—85 are shown around container 83. At each end of the middle groove there are holes for insertion of a locking pin or other suitable means.

From the foregoing, it will be seen that the present invention is well adapted to attain all of the ends and objects hereinabove set forth, together with other advantages which are obvious and which are inherent to the system. With the present invention it is possible to control contamination of products in a plant environment, to reduce plant equipment cleaning costs, to save time required to charge and discharge processing equipment, to use plant space more efficiently, to cut shipping and container costs, and to prevent plant obsolescence when changes occur in products and processes. Accordingly, a significant and major improvement in materials handling procedures for batch operations have been developed which provides for clean, safe, economical and flexible operation.

In accordance with the present invention a container can be connected to or disconnected from a drive station in less than one minute. Most blending and processing cycles require less than 10 minutes. On the basis of 12 minute intervals per batch, it is thus possible to handle five containers in an hour or forty containers per 8 hour shift. Using 50 cubic foot containers, the output capacity is 2000 cubic feet per shift. What can be accomplished is intermittent "continuous" processing.

One of the advantages of the present invention is the fact that containers of varying size, shape and construction can be adapted for utilization with the docking station by simply attaching a frame to the container which will permit quick connect-disconnect operations with the docking station. Preferred containers have a triple wall construction, such as an exterior layer of suitable material, such as aluminum, an intermediate layer of insulating and/or spacing material such as, styrofoam or polyurethane and an interior layer of metal, such as stainless steel, or plastic, such as polypropylene. This triple wall construction has certain inherent advantages over a single walled container not only with respect to structural aspects and weight but also with respect to temperature control. Triple wall construction permits impact resistant containers to be built from relatively thin wall layers. Obviously, any desired material can be used to fabricate the containers including aluminum, magnesium, carbon, stainless steel, plastic, fiberglass and the like.

The strength of three wall construction makes this type of container ideally suited for interplant transportation by conventional means, such as rail, truck or air shipment. To provide even further structural strength the containers in a preferred embodiment have means such as a cable or tie rod attached to each corner or fork lift channel, thereby connecting the top and bottom of the container. This preferred construction permits the containers to be picked up and suspended and, if desired, for the container to have a floating interior shell. Due to the structural strength of the containers they can be positioned in an upright position or in an inverted position. Accordingly, an improved container design is provided which permits empty containers to be forwarded to suppliers for receiving materials sealed inside ready for processing thereby making it possible to eliminate the need for discarding empty drums. The system of the present invention also permits a manufacturer to ship containerized formulations to regional plants for further operations, such as tableting and packaging. The incorporation of a built-in impeller or agitator (e.g., mixing bar) simplifies the stirring required in connection with formulations which tend to settle and compact after shipment or long storage periods.

The apparatus and process of the present invention can be used in connection with almost any dry bulk/liquid material. The list of materials which can advantageously be handled is practically limitless and could include powders, colors, pigments, minerals, synthetic products, fine and heavy chemicals, dyes, intermediates, resins, molding powders, plastics, liquid adhesives, lacquers, thinners, paints, petrochemicals, food materials such as liquid chocolate, sugar, coffee and the like. For materials which tend to solidify in storage or transit, the apparatus of the present invention can be equipped with means for cooling the contents, such as refrigeration coils.

As previously mentioned, the containers can be equipped with rotating bars which will assist in blending materials, in discharging materials, in breaking up lumps, and the like. Conveniently, these rotating bars are mounted in the container with an end arranged to automatically become engaged with a turning mechansim located on the docking station when the container is connected with the docking station. If desired a dispersion device can be incorporated into an agitator bar. Such a device would permit liquid mist to pass through narrow slots in the agitator bar into the material inside the container. This liquid introduction provides uniform distribution of liquid and wetting of internal material. Similar equipment can also be used to introduce a gas into the material being processed. Instead of being used to introduce material into the container, the equipment can also be used to withdraw air from the container to create a vacuum.

To provide for dust free charging and discharging of solid ingredients, containers can be provided with ports that fit dust tight charging and discharging spouts such that ingredients can be added and withdrawn without contaminating either the product or the environment. An advantage of the docking station is that it permits a container to be precisely aligned. This means that a container can be charged from a floor above or discharged to a floor below while being held in precise alignment with a chute or floor opening.

While the illustrated containers are conveniently moved with a conventional lift fork, obviously the containers can be equipped with hoisting eyes, rollers, casters, or other common means for positioning and moving the containers.

Obviously, many other mofifications and variations of the invention as hereinbefore set forth can be made without departing from the spirit and scope thereof.

What is claimed is:

1. Apparatus for handling material comprising; at least one containing member, said containing member comprising a plurality of sides, each of said sides having a predetermined transverse dimension, means for interconnecting at least two adjacent sides so that they are disposed at a predetermined angle with respect to each other, each of said two adjacent sides including elongated transversely extending fitting means; two elongated arms; means for supporting said arms at said predetermined angle so that said arms can lie along said adjacent sides without regard to the transverse dimensions of said sides; elongated fitting means supported by and extending along said arms, said last named fitting means being receivable into complementary engagement with said fitting means on said containing member so that said arms can support said containing member; and retractable means mounted on said arms for movement into and out of engagement with said containing member to restrain said containing member from moving away from said arms.

2. Apparatus as defined in claim 1 including means for rotating said arms.

3. Apparatus as defined in claim 1 including a container, and said container is supported by said containing member.

4. Apparatus as defined in claim 3 wherein said said container is circular.

5. Apparatus as defined in claim 1 wherein said predetermined angle is a right angle.

6. Apparatus as defined in claim 1 wherein said complementary fitting means include at least one elongated groove and one elongated rib to be received therein.

7. Apparatus as defined in claim 1 wherein said retractable means comprise a plurality of pins and said containing member includes complementary apertures, and said pins are movable into and out of said apertures.

8. Apparatus as defined in claim 7 wherein there are only two pins and said pins are on opposite sides of the means for supporting said arms.

9. Apparatus as defined in claim 1 wherein said retractable means includes a longitudinally extending track along each of said arms and a means movable along said tracks for engagement with said containing member.

10. An apparatus as defined in claim 1 wherein said two sides of said containing member have the same transverse dimension.

11. An apparatus as defined in claim 1 wherein said two sides of said containing member have different transverse dimensions.

12. An apparatus as defined in claim 1 including a second containing member, said second containing member having at least two side walls that correspond to the two named side walls on said first containing member, and at least one of said side walls on said second containing member has a different transverse dimension than the corresponding side wall of said first containing member.

* * * * *

UNITED STATES PATENT OFFICE

CERTIFICATE OF CORRECTION

Patent No. 4,077,613 Dated March 7, 1978

Inventor(s) William Wilson

It is certified that error appears in the above-identified patent and that said Letters Patent are hereby corrected as shown below:

Substitute the following claim for patent Claim 3:

--3. Apparatus as defined in Claim 1 wherein said containing member includes a container.--

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*